US007946657B2

(12) United States Patent
Hall et al.

(10) Patent No.: US 7,946,657 B2
(45) Date of Patent: May 24, 2011

(54) RETENTION FOR AN INSERT

(75) Inventors: David R. Hall, Provo, UT (US); Scott Dahlgren, Alpine, UT (US)

(73) Assignee: Schlumberger Technology Corporation, Houston, TX (US)

( * ) Notice: Subject to any disclaimer, the term of this patent is extended or adjusted under 35 U.S.C. 154(b) by 344 days.

(21) Appl. No.: 12/169,345

(22) Filed: Jul. 8, 2008

(65) Prior Publication Data

US 2008/0264697 A1 Oct. 30, 2008

Related U.S. Application Data

(63) Continuation-in-part of application No. 12/112,815, filed on Apr. 30, 2008, now Pat. No. 7,871,133, which is a continuation of application No. 12/112,743, filed on Apr. 30, 2008, which is a continuation-in-part of application No. 12/051,738, filed on Mar. 19, 2008, now Pat. No. 7,669,674, which is a continuation of application No. 12/051,689, filed on Mar. 19, 2008, which is a continuation-in-part of application No.

(Continued)

(51) Int. Cl.
*E21C 35/197* (2006.01)

(52) U.S. Cl. ..... 299/113; 299/111

(58) Field of Classification Search ..... 299/104, 299/105, 106, 113, 111; 411/2, 3, 5
See application file for complete search history.

(56) References Cited

U.S. PATENT DOCUMENTS 2,004,315 A 6/1935 Fean (Continued)

FOREIGN PATENT DOCUMENTS

DE 3307910 9/1984

(Continued)

OTHER PUBLICATIONS

G. Jeffrey Hoch, "NPL—Is There Room for Geothermal Energy, Innovation: America's Journal of Tech Communicationhttp://www.innovation-america.org/", Dec. 2006-Jan. 2007.

(Continued)

*Primary Examiner* — John Kreck
(74) *Attorney, Agent, or Firm* — Holme Roberts & Owen LLP

(57) ABSTRACT

A degradation assembly for attachment to a driving mechanism used for degrading a formation. The degradation assembly includes both a cutting structure and a tensioning element adapted to connect the cutting structure to the driving mechanism. The tensioning element includes a body having a engaging structure adapted to engage with the cutting structure on a first end, a thread adapted to engage with the driving mechanism proximate a second end, a necked region between the engaging structure and the thread which is operable to break when acted upon by a predetermined tensile force, and a torque member extending from the engaging structure that engages with the cutting structure to transfer torque between the cutting structure and the body, and which torque member is operable to break when acted upon by a predetermined torque.

19 Claims, 11 Drawing Sheets

Related U.S. Application Data

12/051,586, filed on Mar. 19, 2008, which is a continuation-in-part of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS

| | | | | | |
|---|---|---|---|---|---|
| 2,124,438 | A | | 7/1938 | Struk | |
| 2,247,499 | A | * | 7/1941 | Hutchison, Jr | 411/378 |
| 2,972,713 | A | | 6/1958 | Sutton, Jr. | |
| 3,089,215 | A | | 5/1963 | Stubbs | |
| 3,254,392 | A | | 6/1966 | Novkov | |
| 3,342,531 | A | | 9/1967 | Krekeler | |
| 3,342,532 | A | | 9/1967 | Krekeler | |
| 3,595,124 | A | * | 7/1971 | Lindstrand et al. | 411/2 |
| 3,627,381 | A | | 12/1971 | Krekeler | |
| 3,746,396 | A | | 7/1973 | Radd | |
| 3,778,112 | A | | 12/1973 | Krekeler | |
| 3,800,891 | A | | 4/1974 | White et al. | |
| 3,807,804 | A | | 4/1974 | Kniff | |
| 3,830,321 | A | | 8/1974 | McKenry | |
| 3,929,054 | A | * | 12/1975 | Gutshall | 411/5 |
| 3,932,952 | A | | 1/1976 | Helton | |
| 3,942,838 | A | | 3/1976 | Bailey et al. | |
| 3,945,681 | A | | 3/1976 | White | |
| 4,005,914 | A | | 2/1977 | Newman | |
| 4,006,936 | A | | 2/1977 | Crabiel | |
| 4,098,362 | A | | 7/1978 | Bonnice | |
| 4,109,737 | A | | 8/1978 | Bovenkerk | |
| 4,149,753 | A | | 4/1979 | Stoltz | |
| 4,156,329 | A | | 5/1979 | Daniels | |
| 4,199,035 | A | | 4/1980 | Thompson | |
| 4,201,421 | A | | 5/1980 | Den Besten | |
| 4,277,106 | A | | 7/1981 | Sahley | |
| 4,439,250 | A | | 3/1984 | Acharya | |
| 4,465,221 | A | | 8/1984 | Schmidt | |
| 4,484,644 | A | | 11/1984 | Cook | |
| 4,489,986 | A | | 12/1984 | Dziak | |
| 4,583,786 | A | | 4/1986 | Thorpe et al. | |
| 4,647,111 | A | | 3/1987 | Bronder et al. | |
| 4,669,786 | A | | 6/1987 | Morgan et al. | |
| 4,678,237 | A | | 7/1987 | Collin | |
| 4,682,987 | A | | 7/1987 | Brady | |
| 4,688,856 | A | | 8/1987 | Elfgen | |
| 4,725,098 | A | | 2/1988 | Beach | |
| 4,729,603 | A | | 3/1988 | Elfgen | |
| 4,765,686 | A | | 8/1988 | Adams | |
| 4,765,687 | A | | 8/1988 | Parrott | |
| 4,776,862 | A | | 10/1988 | Wiand | |
| 4,880,154 | A | | 11/1989 | Tank | |
| 4,932,723 | A | | 6/1990 | Mills | |
| 4,940,288 | A | | 7/1990 | Stiffler | |
| 4,944,559 | A | | 7/1990 | Sionnet | |
| 4,951,762 | A | | 8/1990 | Lundell | |
| 5,011,515 | A | | 4/1991 | Frushour | |
| 5,112,165 | A | | 5/1992 | Hedlund | |
| 5,119,714 | A | | 6/1992 | Scott et al. | |
| 5,141,289 | A | | 8/1992 | Stiffler | |
| 5,154,245 | A | | 10/1992 | Waldenstrom | |
| 5,186,892 | A | | 2/1993 | Pope | |
| 5,251,964 | A | | 10/1993 | Ojanen | |
| 5,261,499 | A | | 11/1993 | Grubb | |
| 5,332,348 | A | | 7/1994 | Lemelson | |
| 5,417,475 | A | | 5/1995 | Graham | |
| 5,447,208 | A | | 9/1995 | Lund | |
| 5,494,477 | A | | 2/1996 | Flood et al. | |
| 5,535,839 | A | | 7/1996 | Brady | |
| 5,542,993 | A | | 8/1996 | Rabinkin | |
| 5,653,300 | A | | 8/1997 | Lund | |
| 5,662,720 | A | | 9/1997 | O'Tighearnaigh | |
| 5,713,412 | A | | 2/1998 | Wepfer et al. | |
| 5,738,698 | A | | 4/1998 | Kapoor | |
| 5,823,632 | A | | 10/1998 | Burkett | |
| 5,837,071 | A | | 11/1998 | Andersson | |
| 5,842,747 | A | | 12/1998 | Winchester | |
| 5,845,547 | A | | 12/1998 | Sollami | |
| 5,875,862 | A | | 3/1999 | Jurewicz | |
| 5,890,552 | A | | 4/1999 | Scott et al. | |
| 5,934,542 | A | | 8/1999 | Nakamura | |
| 5,935,718 | A | | 8/1999 | Demo | |
| 5,944,129 | A | | 8/1999 | Jensen | |
| 5,967,250 | A | | 10/1999 | Lund | |
| 5,992,405 | A | | 11/1999 | Sollami | |
| 6,000,483 | A | | 12/1999 | Jurewicz et al. | |
| 6,004,349 | A | * | 12/1999 | Jackson | 606/270 |
| 6,006,846 | A | | 12/1999 | Tibbitts | |
| 6,019,434 | A | | 2/2000 | Emmerich | |
| 6,044,920 | A | | 4/2000 | Massa | |
| 6,051,079 | A | | 4/2000 | Andersson | |
| 6,056,911 | A | | 5/2000 | Griffin | |
| 6,065,552 | A | | 5/2000 | Scott | |
| 6,086,160 | A | * | 7/2000 | Bitelli | 299/104 |
| 6,113,195 | A | | 9/2000 | Mercier | |
| 6,170,917 | B1 | | 1/2001 | Heinrich | |
| 6,193,770 | B1 | | 2/2001 | Sung | |
| 6,196,636 | B1 | | 3/2001 | Mills | |
| 6,196,910 | B1 | | 3/2001 | Johnson | |
| 6,199,956 | B1 | | 3/2001 | Kammerer | |
| 6,216,805 | B1 | | 4/2001 | Lays | |
| 6,270,165 | B1 | | 8/2001 | Peay | |
| 6,341,823 | B1 | | 1/2002 | Sollami | |
| 6,354,771 | B1 | | 3/2002 | Bauschulte | |
| 6,364,420 | B1 | | 4/2002 | Sollami | |
| 6,371,567 | B1 | | 4/2002 | Sollami | |
| 6,375,272 | B1 | | 4/2002 | Ojanen | |
| 6,419,278 | B1 | | 7/2002 | Cunningham | |
| 6,460,637 | B1 | | 10/2002 | Siracki et al. | |
| 6,478,383 | B1 | | 11/2002 | Ojanen | |
| 6,499,547 | B2 | | 12/2002 | Scott | |
| 6,517,902 | B2 | | 2/2003 | Drake | |

| | | | | |
|---|---|---|---|---|
| 6,585,326 | B2 | 7/2003 | Sollami | |
| 6,601,662 | B2 | 8/2003 | Matthias et al. | |
| 6,659,206 | B2 | 12/2003 | Liang et al. | |
| 6,685,273 | B1 | 2/2004 | Sollami | |
| 6,692,083 | B2 | 2/2004 | Latham | |
| 6,709,065 | B2 | 3/2004 | Peay | |
| 6,719,074 | B2 | 4/2004 | Tsuda | |
| 6,733,087 | B2 | 5/2004 | Hall | |
| 6,739,327 | B2 | 5/2004 | Sollami | |
| 6,758,530 | B2 | 7/2004 | Sollami | |
| 6,786,557 | B2 | 9/2004 | Montgomery, Jr. | |
| 6,824,225 | B2 | 11/2004 | Stiffler | |
| 6,851,758 | B2 | 2/2005 | Beach | |
| 6,854,810 | B2 | 2/2005 | Montgomery, Jr. | |
| 6,861,137 | B2 | 3/2005 | Griffin | |
| 6,889,890 | B2 | 5/2005 | Yamazaki et al. | |
| 6,938,961 | B2 | 9/2005 | Broom | |
| 6,966,611 | B1 | 11/2005 | Sollami | |
| 6,994,404 | B1 | 2/2006 | Sollami | |
| 7,204,560 | B2 | 4/2007 | Mercier | |
| 7,234,782 | B2 | 6/2007 | Stehney | |
| 7,316,532 | B2 * | 1/2008 | Matthys-Mark | 411/5 |
| 2002/0175555 | A1 | 11/2002 | Mercier | |
| 2003/0141350 | A1 | 7/2003 | Noro | |
| 2003/0209366 | A1 | 11/2003 | McAlvain | |
| 2003/0234280 | A1 | 12/2003 | Cadden | |
| 2004/0026983 | A1 | 2/2004 | McAlvain | |
| 2004/0065484 | A1 | 4/2004 | McAlvain | |
| 2005/0159840 | A1 | 7/2005 | Lin | |
| 2005/0173966 | A1 | 8/2005 | Mouthaan | |
| 2006/0237236 | A1 | 10/2006 | Sreshta | |

FOREIGN PATENT DOCUMENTS

| | | |
|---|---|---|
| DE | 3431495 | 3/1986 |
| DE | 3500261 | 7/1986 |
| DE | 3818213 | 11/1989 |
| DE | 4039217 | 6/1992 |
| DE | 19821147 | 11/1999 |
| DE | 10163717 | 5/2003 |
| EP | 0295151 | 6/1988 |
| EP | 0412287 | 7/1990 |
| GB | 2004315 | 3/1979 |
| GB | 2037223 | 11/1979 |
| JP | 5280273 A | 11/1993 |

OTHER PUBLICATIONS

US Dept. of Energy, NPL—Geothermal Drilling Faster & Cheaper is Better, Geothermal Today, p. 28, National Renewal Energy Laboratory Golden, Colorado, May 2000.

David A. Glowka, et al., "NPL—Progress in the Advanced Synthetic-Diamond Drill Bit Program", 1995.

Mark A. Taylor, "NPL—The State of Geothermal Technology Part 1: Subsurface Technology, pp. 29-30, Geothermal Energy Association, Washington, D.C.", Nov. 2007.

Christopher J. Durrand, NPL—Super-hard, Thick Shaped PDC Cutters for Hard Rock Drilling: Development & Test Results, Geothermal Reservoir Engineering, Stanford, California, Feb. 3, 2010.

Dan Jennejohn, "NPL—Research & Development in Geothermal Exploration & Drilling, pp. 15, 18-19, Geothermal Energy Association, Washington, D.C.", Dec. 1, 2009.

* cited by examiner

RETENTION FOR AN INSERT

RELATED APPLICATIONS

This application is a continuation-in-part of U.S. patent application Ser. No. 12/112,815, filed on Apr. 30, 2008, which is a continuation of U.S. patent application Ser. No. 12/112,743, filed on Apr. 30, 2008, which is a continuation-in-part of U.S. patent application Ser. No. 12/051,738, filed on Mar. 19, 2008, now U.S. Pat. No. 7,669,674, which is a continuation of U.S. patent application Ser. No. 12/051,689, filed on Mar. 19, 2008, which is a continuation-in-part of U.S. patent application Ser. No. 12/051,586, filed on Mar. 19, 2008, which is a continuation-in-part of U.S. patent application Ser. No. 12/021,051, filed on Jan. 28, 2008, which is a continuation-in-part of U.S. patent application Ser. No. 12/021,019, filed on Jan. 10, 2008, which is a continuation-in-part of U.S. patent application Ser. No. 11/971,965, filed on Jan. 10, 2008, now U.S. Pat. No. 7,648,210, which is a continuation of U.S. patent application Ser. No. 11/947,644, filed on Nov. 29, 2007, which is a continuation-in-part of U.S. patent application Ser. No. 11/844,586, filed on Aug. 24, 2007, now U.S. Pat. No. 7,600,823. U.S. patent application Ser. No. 11/844,586 is a continuation in part of U.S. patent application Ser. No. 11/829,761, filed on Jul. 27, 2007, now U.S. Pat. No. 7,722,127. U.S. patent application Ser. No. 11/829,761 is a continuation-in-part of U.S. patent application Ser. No. 11/773,271, filed on Jul. 3, 2007. U.S. patent application Ser. No. 11/773,271 is a continuation-in-part of U.S. patent application Ser. No. 11/766,903, filed on Jun. 22, 2007. U.S. patent application Ser. No. 11/766,903 is a continuation of U.S. patent application Ser. No. 11/766,865, filed on Jun. 22, 2007. U.S. patent application Ser. No. 11/766,865 is a continuation-in-part of U.S. patent application Ser. No. 11/742,304, filed on Apr. 30, 2007. U.S. patent application Ser. No. 11/742,304 is a continuation of U.S. patent application Ser. No. 11/742,261, filed on Apr. 30, 2007, now U.S. Pat. No. 7,469,971. U.S. patent application Ser. No. 11/742,261 is a continuation-in-part of U.S. patent application Ser. No. 11/464,008, filed on Aug. 11, 2006, now U.S. Pat. No. 7,338,135. U.S. patent application Ser. No. 11/464,008 is a continuation-in-part of U.S. patent application Ser. No. 11/463,998, filed on Aug. 11, 2006, now U.S. Pat. No. 7,384,105. U.S. patent application Ser. No. 11/463,998 is a continuation-in-part of U.S. patent application Ser. No. 11/463,990, filed on Aug. 11, 2006, now U.S. Pat. No. 7,320,505. U.S. patent application Ser. No. 11/463,990 is a continuation-in-part of U.S. patent application Ser. No. 11/463,975, filed on Aug. 11, 2006, now U.S. Pat. No. 7,445,294. U.S. patent application Ser. No. 11/463,975 is a continuation-in-part of U.S. patent application Ser. No. 11/463,962, filed Aug. 11, 2006, now U.S. Pat. No. 7,413,256. U.S. patent application Ser. No. 11/463,962 is a continuation-in-part of U.S. patent application Ser. No. 11/463,953, filed on Aug. 11, 2006, now U.S. Pat. No. 7,464,993. The present application is also a continuation-in-part of U.S. patent application Ser. No. 11/695,672, filed in Apr. 3, 2007, now U.S. Pat. No. 7,396,086. U.S. patent application Ser. No. 11/695,672 is a continuation-in-part of U.S. patent application Ser. No. 11/686,831, filed on Mar. 15, 2007, now U.S. Pat. No. 7,568,770. All of these applications are herein incorporated by reference for all that they contain.

FIELD OF THE INVENTION

This invention relates to tensioning elements, specifically tensioning elements used with degradation assemblies attached to a driving mechanism used for degrading a formation, such as drill bits, mining machines, trenchers and excavation machinery. More particularly, the invention relates to cutting elements or structures in the degradation assemblies that include a carbide substrate with an abrasion resistant layer of superhard material.

BACKGROUND OF THE INVENTION

U.S. patent application Ser. No. 12/051,689 by Hall et al., which is herein incorporated by reference for all that it contains, discloses a degradation assembly having a working portion with at least one impact tip brazed to a carbide extension. The carbide extension has a cavity formed in a base end and is adapted to interlock with a shank assembly of the cutting element assembly. The shank assembly has a locking mechanism adapted to interlock a first end of the shank assembly within the cavity. The locking mechanism has a radially extending catch formed in the first end of the shank assembly. The shank assembly has an outer surface at a second end of the shank assembly adapted to be press-fitted within a recess of a driving mechanism. The outer surface of the shank assembly has a coefficient of thermal expansion of 110 percent or more than a coefficient of thermal expansion of a material of the driving mechanism.

U.S. Pat. No. 6,332,503 by Pessier et al, which is herein incorporated by reference for all that it contains, discloses an array of chisel-shaped cutting elements are mounted to the face of a fixed cutter bit. Each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al, which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 4,109,737 by Bovenkerk which is herein incorporated by reference for all that it contains, discloses a rotary bit for rock drilling comprising a plurality of cutting elements mounted by interence-fit in recesses in the crown of the drill bit. Each cutting element comprises an elongated pin with a thin layer of polycrystalline diamond bonded to the free end of the pin.

US Patent Application Serial No. 2001/0004946 by Jensen, although now abandoned, is herein incorporated by reference for all that it discloses. Jensen teaches that a cutting element or insert with improved wear characteristics while maximizing the manufacturability and cost effectiveness of the insert.

This insert employs a superabrasive diamond layer of increased depth and by making use of a diamond layer surface that is generally convex.

BRIEF SUMMARY OF THE INVENTION

In one aspect of the present invention, a tensioning element is adapted to connect a first object to a second object. The tensioning element includes a body having an engaging structure extending away from a first end that is adapted to engage with the first object, a thread formed proximate a second end that is adapted to engage with the second object, and a neck or tension break point between the engaging structure and the thread that is operable to break upon application of a predetermined tensile force between the first and second ends of the body. The tensioning element also includes a breakaway torque member affixed to and extending from the engaging structure on a support formed with a weak area or torque break point, and which is operable to break upon application of a predetermined torque between the first object and the second object.

The tensioning element may be included within a degradation assembly that is attached to a driving mechanism used for degrading a formation, such as a downhole drill bit, an excavation drum, and/or a downhole tool string. The tensioning element may comprise a removal interface disposed between the engaging member and the thread formed proximate the second end. The removal interface may comprise a wrench flat.

The breakaway torque member may be adapted to break away at a lower strain then the breakable union. The breakaway torque member may also be adapted to break off once the thread has been sufficiently torqued. The torque required to breakaway the breakaway torque bearing feature may be greater then the torque required to seat the thread form. The tensioning element may be disposed within a blind hole.

The first object may comprise a carbide bolster attached to a tip comprising a super hard material. A cavity in the bolster may be formed of two segments fixed to each other. The engaging structure may comprise a catch. The engaging structure and the cavity of the first object may form a spherical ball joint socket. The first object may interlock with the engaging structure. The first object may comprise an internal cavity that is adapted to axially interlock with the engaging structure. The first object may comprise a connection point, adapted for connection of a puller or tightening instrument.

DETAILED DESCRIPTION OF EDEXEMPLARY EMBODIMENTS

Figure 1:
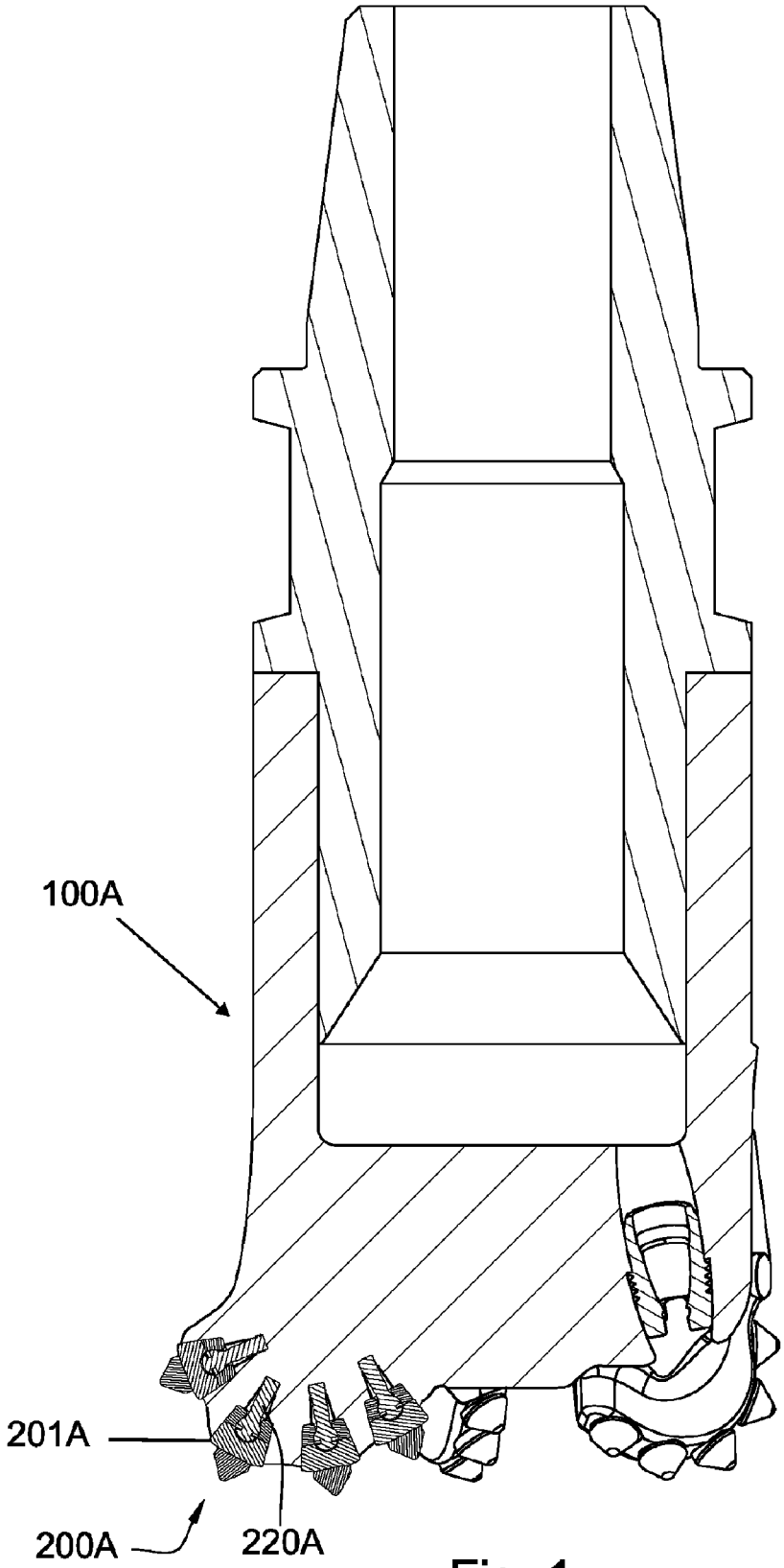
FIG. 1 is a cross-sectional diagram of an embodiment of a drill bit.

FIG. 1 shows a cross sectional diagram of an embodiment of a drill bit 100A. A degradation assembly 200A may be disposed within the bit. The degradation assembly 200A may comprise a cutting structure 201A attached to the drill bit or driving mechanism with a tensioning assembly 220A.

Figure 2A:
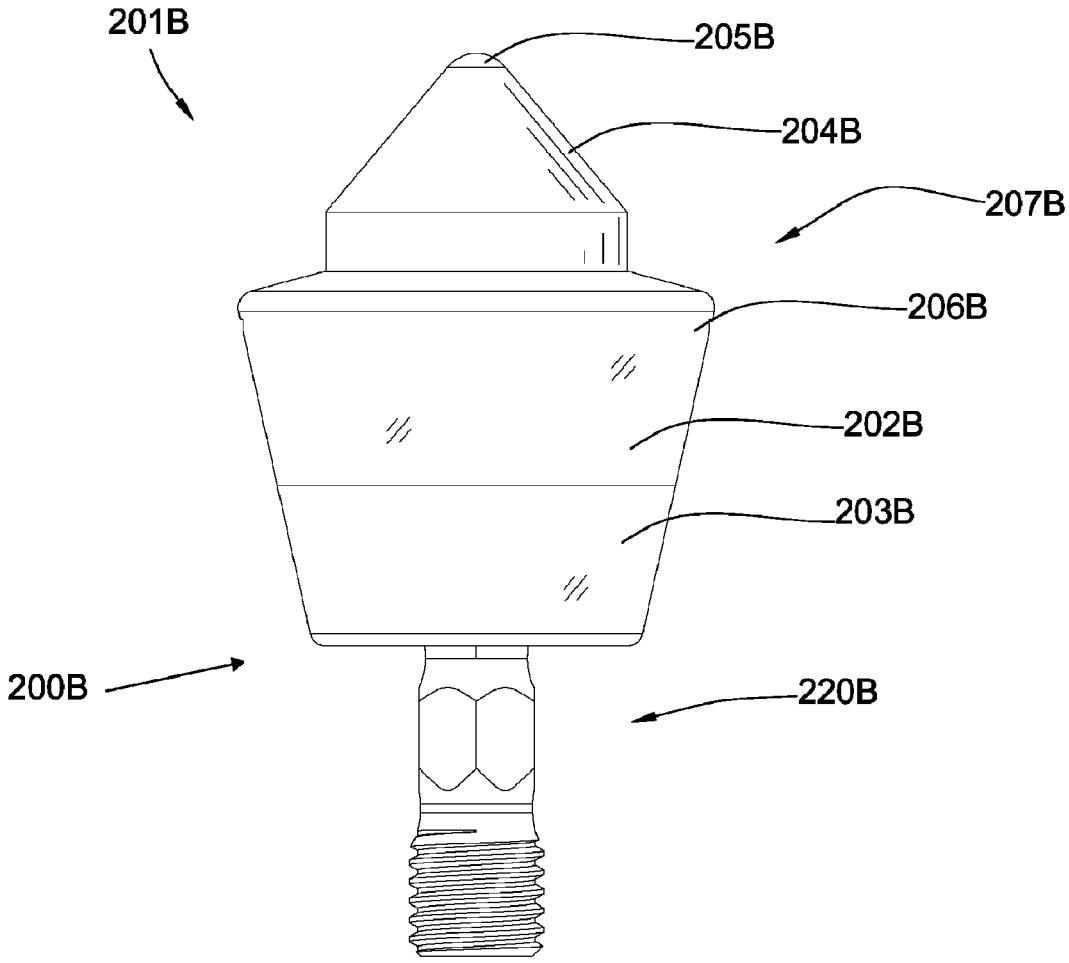
FIG. 2*a* is a side view of an embodiment of a degradation assembly.

FIG. 2*a* shows a side view of an embodiment of a degradation assembly 200B having a pick or cutting structure 201B with a tensioning element 220B disposed therein. The cutting structure 201B may comprise a carbide bolster 207B attached to a tip 204B comprising a super hard material 205B. The bolster may comprise a connection point 206B such that a tightening and/or removal tool may be attached to the bolster. The bolster may comprise an upper section 202B and a lower section 203B that have been affixed to each other.

Figure 2B:
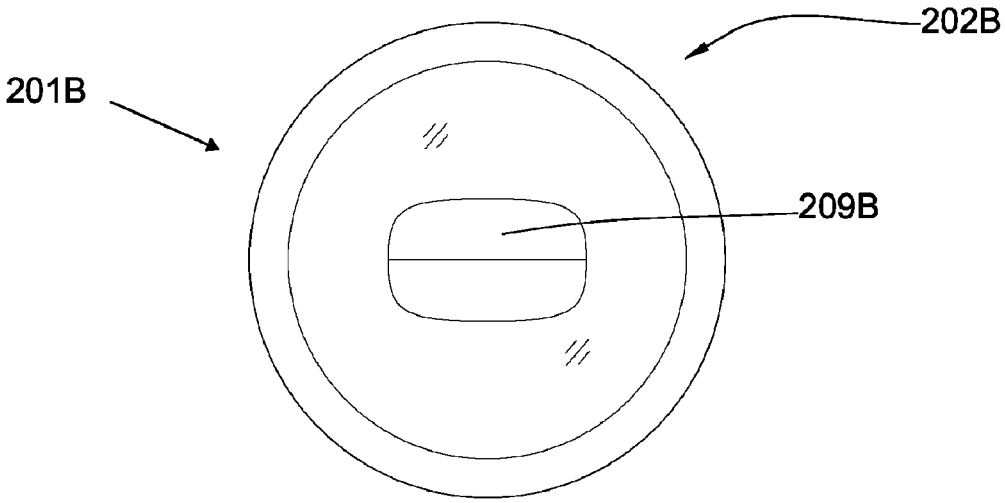
FIG. 2*b* is a bottom view of an embodiment of a bolster of a degradation assembly.

FIG. 2*b* is a bottom view of the upper section 202B of the bolster 207B illustrated in FIG. 2*a*. The upper section 202B may comprise a pocket 209B, such that a breakaway torque member is adapted to seat with the pocket 209B.

Figures 3A, 3B:
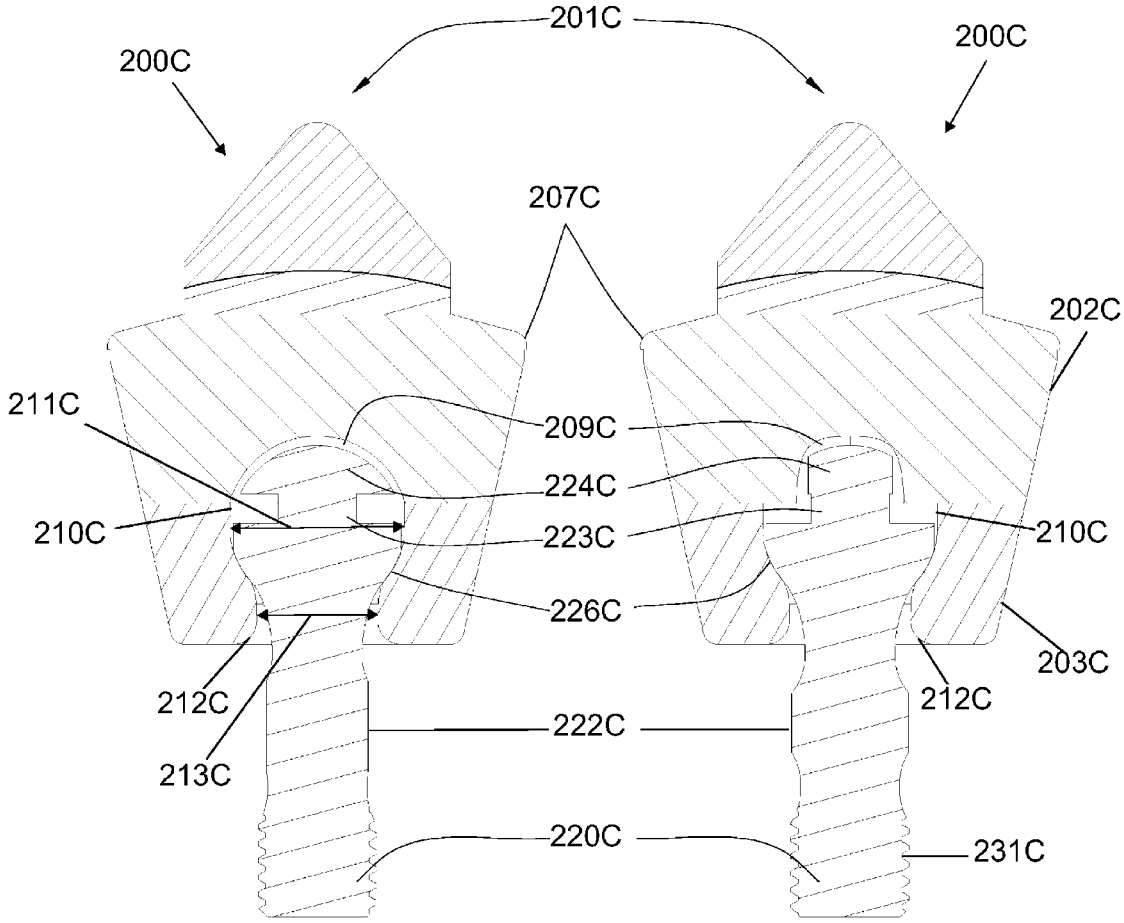
FIG. 3*a* is a cross-sectional diagram of another embodiment of a degradation assembly.
FIG. 3*b* is a cross-sectional diagram of the embodiment of FIG. 3*a* rotated on its axis 90° degrees.

FIG. 3*a* is a cross-sectional diagram of another embodiment of a degradation assembly 200C and FIG. 3*b* is a diagram of the same embodiment of a degradation assembly 200C rotated 90° degrees. The cutting structure 201C of the degradation assembly 200C may comprise a bolster 207C. The bolster 207C may comprise a cavity 210C disposed within the interior of the bolster 207C, and which cavity 210C is accessible through an aperture 212C formed into the base end of the bolster 207C. The cavity 210C can have a cavity width 211C and the aperture can have an aperture width 213C, with the aperture width 213C being less than the cavity width 211C.

The degradation assembly 200C may also comprise a tensioning element 220C that includes a body 222C having an engaging structure or catch 226C formed at one end and a screw thread 231C formed at the other. The engaging structure 226C may be disposed within the cavity 210C of the bolster 207C in such a way that the engaging structure 226C and the cavity 210C may together form a spherical ball joint socket, in which the outer contact or bearing surface of the engaging structure or catch 226C may engage with the inner contact or bearing surfaces of the cavity 210C and aperture 212C that are formed within the interior of the bolster 207C. The width of the engaging structure 226C may also be greater than the aperture width 213C so as to inhibit removal of the end of the tensioning element 220C through the aperture 212C.

The tensioning element 220C may include a breakaway torque member 224C. A torque break point 223C may be disposed below the torque member 224C. The torque member 224C may be disposed within the pocket 209C formed into the upper section 202C of the bolster 207C, and which pocket 209C is in communication with the cavity 210C formed into the lower section 203C of the bolster 207C in the embodiment shown. The torque member 224C is sized and shaped in such a way that, while the torque break point 223C remains unbroken, a torque that is applied to the cutting structure 201C and bolster 207C may be directly transferred through the torque member 224C to the body 222C of the tensioning element 220C.

Figures 4A, 4B:
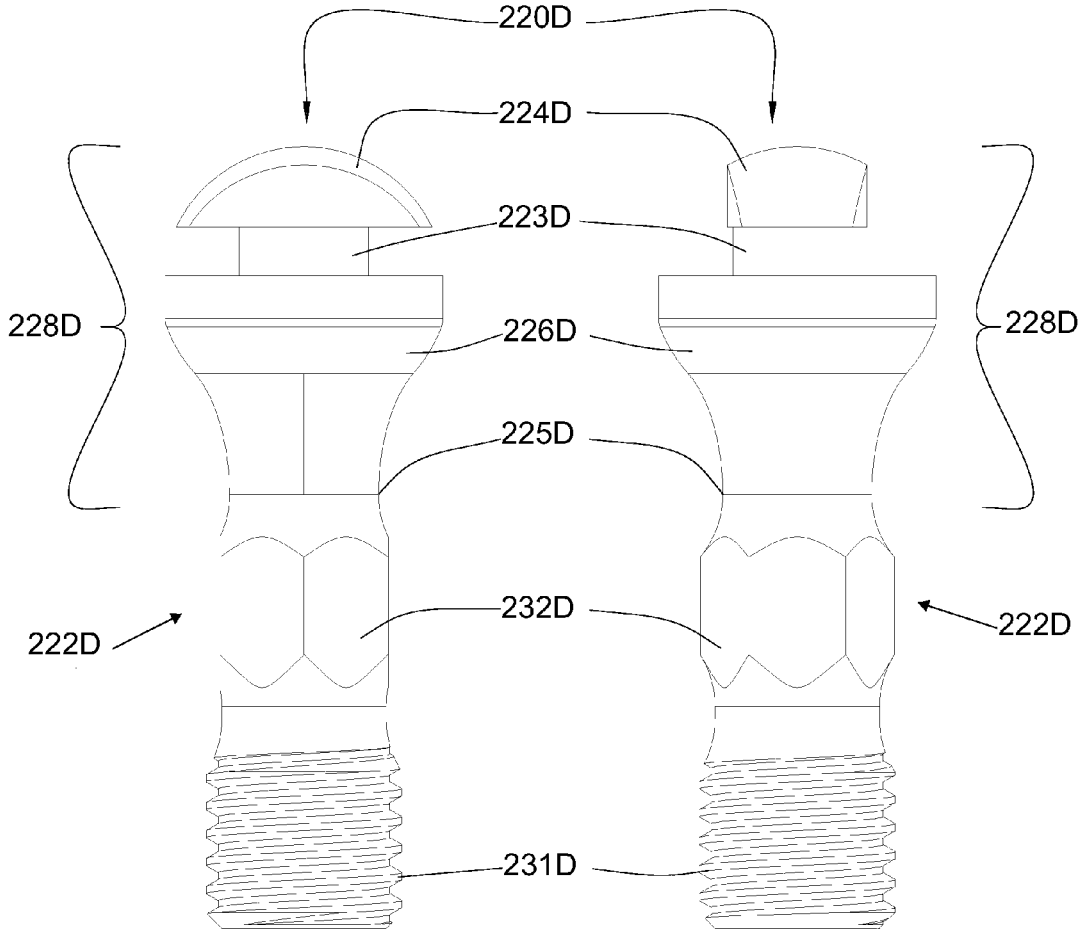
FIG. 4*a* is an orthogonal diagram of an embodiment of a tensioning element.
FIG. 4*b* is an orthogonal diagram of the embodiment of FIG. 4*a* rotated on its axis 90° degrees.

FIG. 4*a* shows an orthogonal view of an embodiment of a tensioning element 220D. FIG. 4*b* shows another orthogonal view of the same tensioning element embodiment 220D rotated axially 90° degrees. The tensioning element 220D may comprise an interlocking geometry 228D on a first end. The interlocking geometry 228D may comprise a breakaway torque member 224D. A torque break point 223D may be disposed below the torque member 224D. When a torque of sufficient strength is applied the torque member 224D may breakaway from the body 222D of the tensioning element 220D at the torque break point 223D.

The interlocking geometry 228D may further comprise a catch or engaging structure 226D through which a tensioning force may be exerted upon a first object, such as the cutting structure shown in FIGS. 3*a* and 3*b*.

The tensioning element 220D may also comprise a tension break point or necked portion 225D located between the engaging structure 226D near the first end of the body 222D and a thread 231D near the second end of the body 222D. When a tension of sufficient force is applied along the length of the tensioning element 220D, the body 222D may break at the tension break point 225D. The tensioning element 220D may further comprise a removal interface or wrench flat 232D, such that a wrench or socket may be able to interface with the tension assembly. The tensioning element 220D may further comprise a thread form 231D, such that the thread form 231D may be disposed within a compatibly threaded hole.

Figure 5:
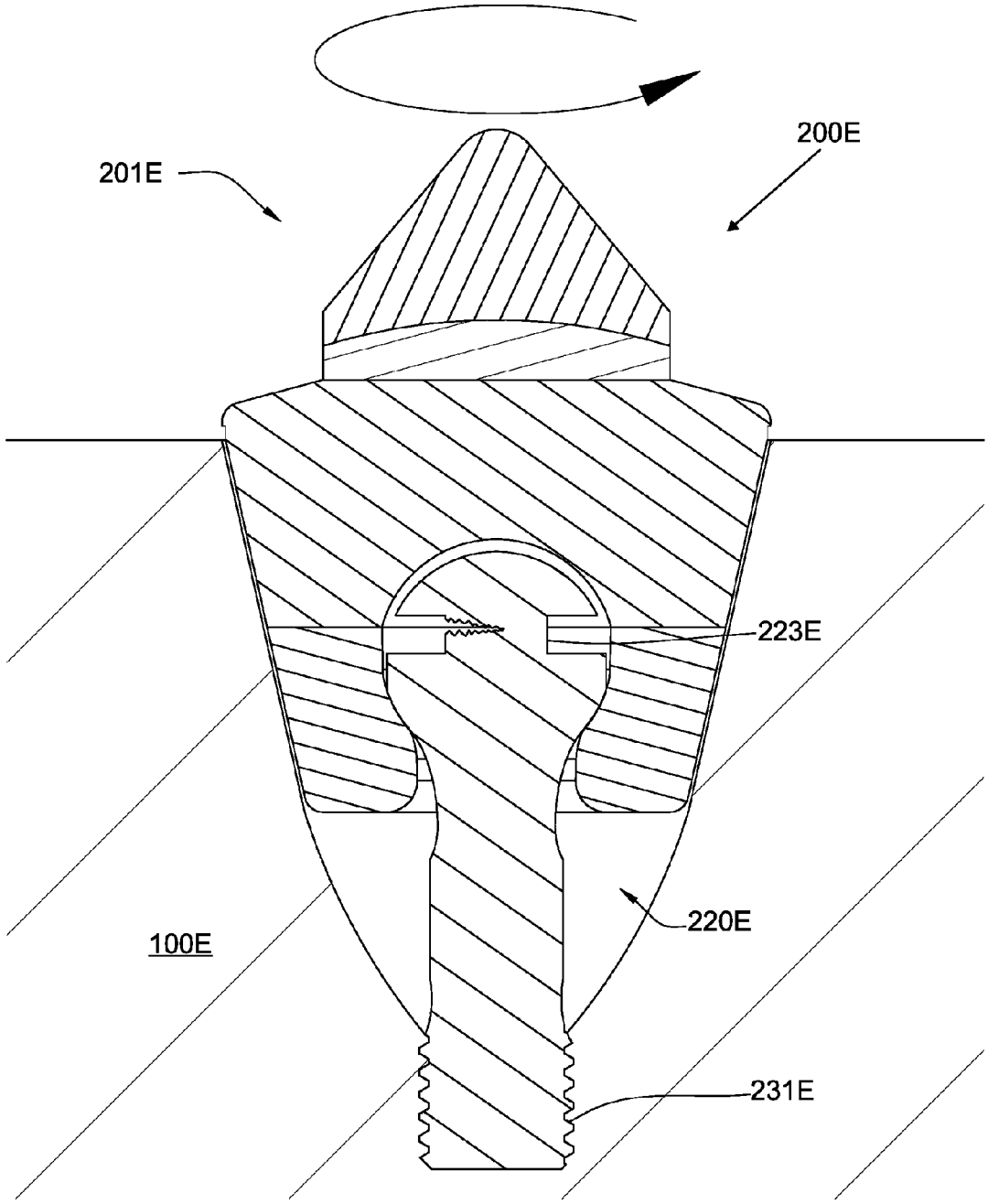
FIG. 5 is a cross-sectional diagram of another embodiment of a degradation assembly.

FIG. 5 is a diagram of an embodiment of a degradation assembly 200E that may be receiving an applied torque. The degradation assembly 200E may be comprised of a cutting structure or pick 201E attached to a driving mechanism 100E with a tensioning element 220E. The threaded of the tensioning element 220E may be disposed within a threaded and/or blind hole formed into the driving mechanism 100E. The applied torque may be of sufficient strength that a torque break point 223E may begin to break. The torque required for the torque break point 223E to break may be greater then the torque required to fully seat the thread 231E of the tensioning element 220E into the threaded and/or blind hole. Upon application of the predetermined torque and the breaking of the torque break point 223E, the cutting structure 201E may rotate with respect to the non-rotating body 222E of the tensioning element 220E on the spherical ball joint socket described with respect to FIGS. 3*a* and 3*b*.

Figure 6:
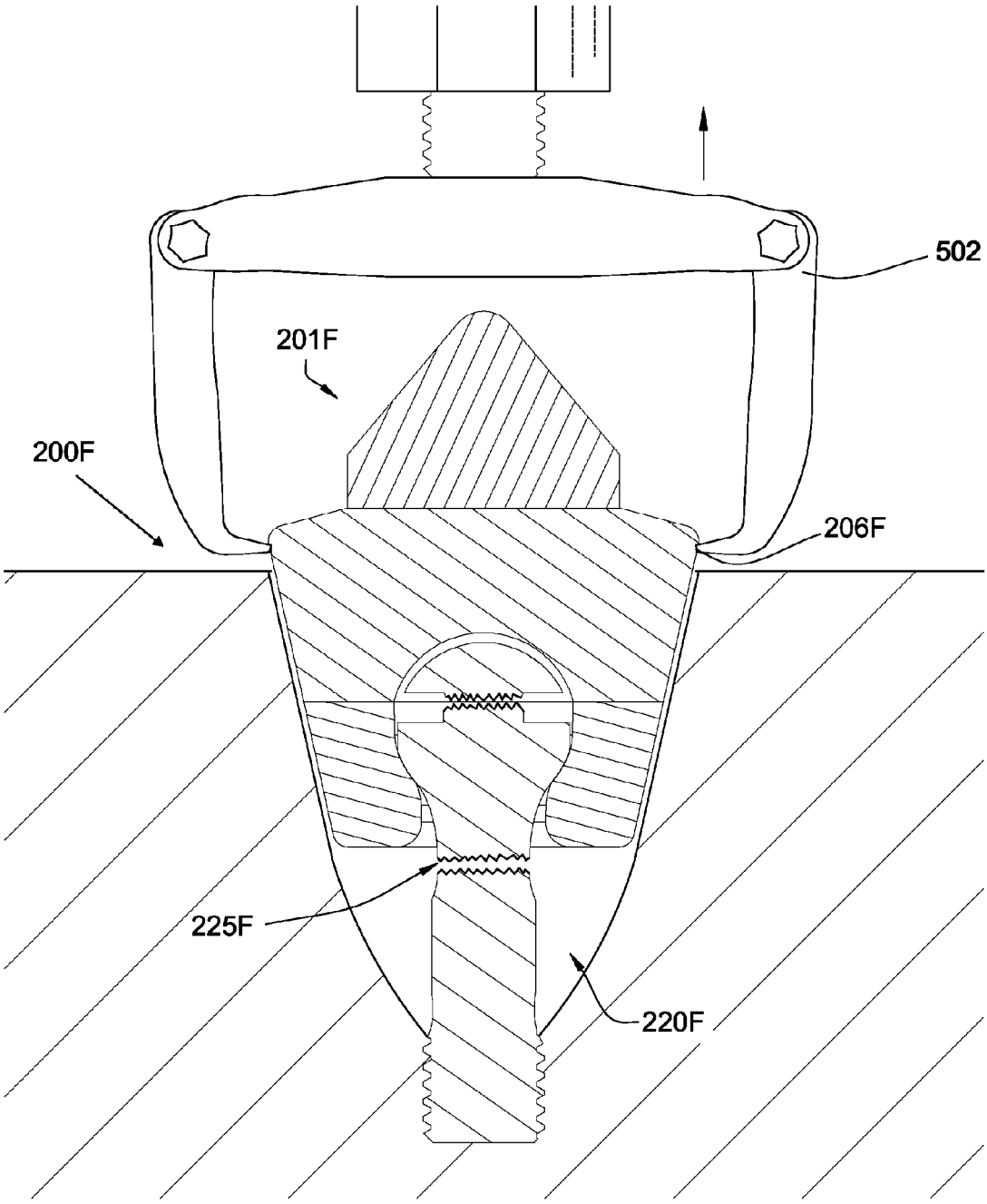
FIG. 6 is a cross-sectional diagram of another embodiment of a degradation assembly.

FIG. 6 is a diagram of an embodiment of a degradation assembly 200F under tension. The tension may be being applied through a puller 502 which may be engaged to the degradation assembly 200F through a connection point 206F formed on the cutting structure 201F. A torque break point or necked portion 225F may already be broken. The tensioning force may be sufficient to break a tension break point 225F, which may enable the removal of the cutting structure 201F.

Figure 7:
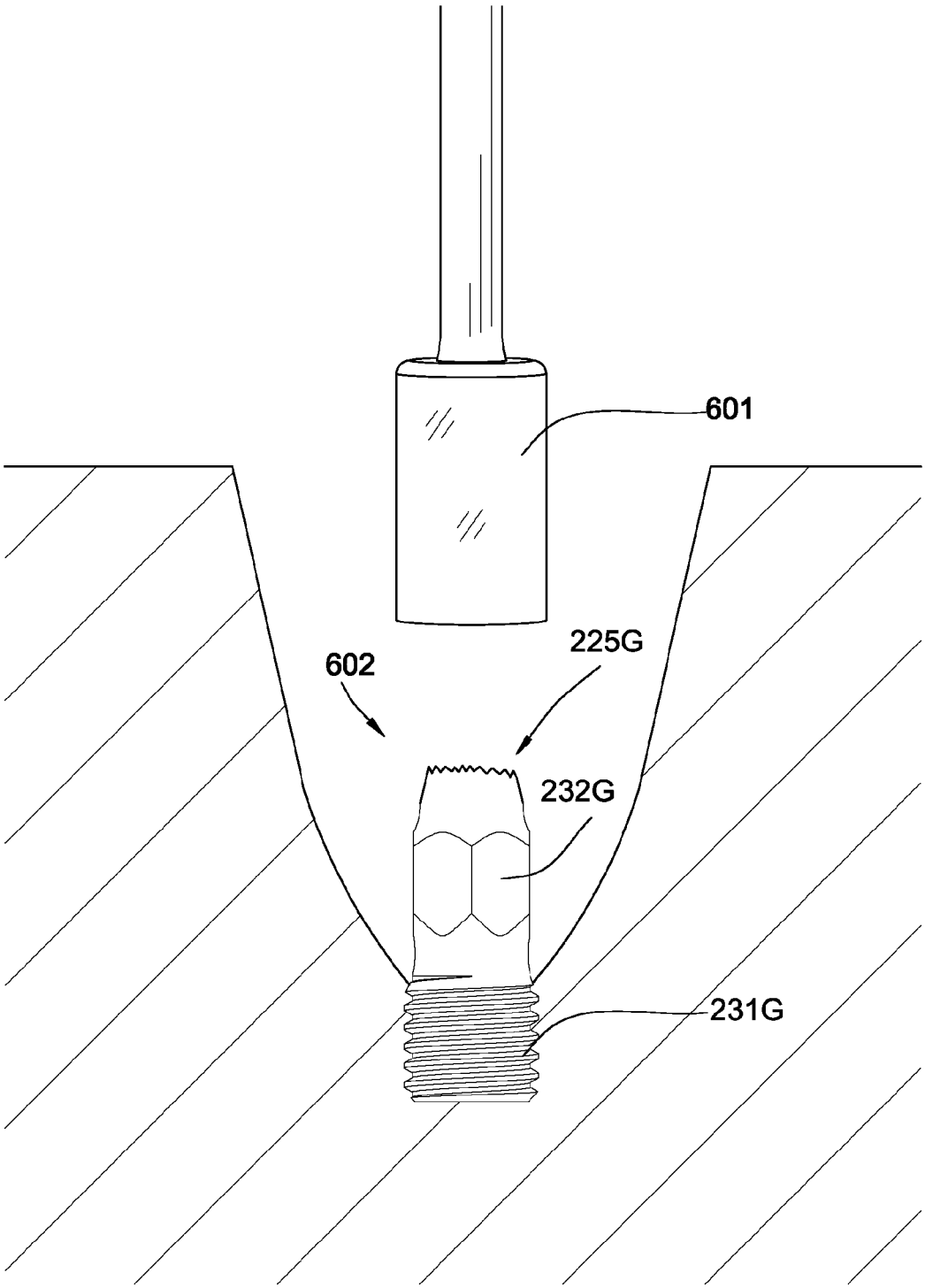
FIG. 7 is a cross-sectional diagram of a portion of the tensioning element of the embodiment of FIG. 6.

FIG. 7 is a diagram of an embodiment of a portion 602 of a tensioning element. The portion 602 may be the remains of the body of a tensioning element after a torque break point 225G has been broken and the cutting structure removed. A wrench 601 may be attached to the portion 602 via the removal interface or wrench flat 232G. It is believed that the wrench 601 may be able unthread the thread 231 G from the threaded hole.

Figure 8A:
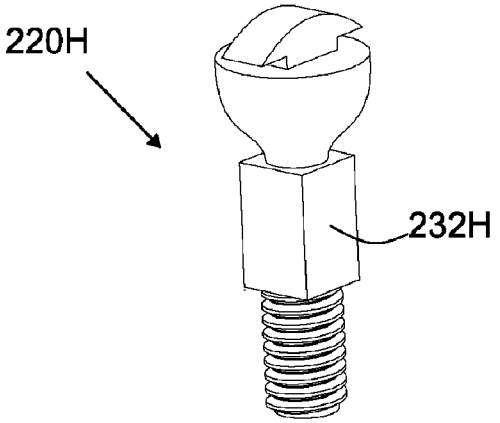
FIG. 8*a* is a perspective view of another embodiment of a tensioning element.

FIG. 8*a* is a perspective view of another embodiment of a tensioning element 220H. The tensioning element may be comprised of a wrench flat 2232H that is in the shape of a square.

Figure 8B:
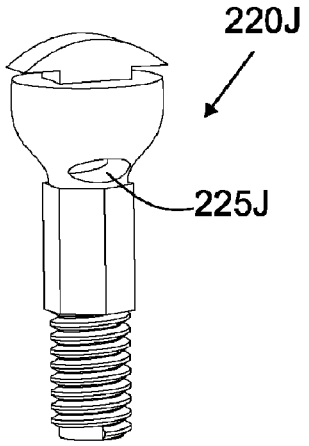
FIG. 8*b* is a perspective view of another embodiment of a tensioning element.

FIG. 8*b* is a perspective view of another embodiment of a tensioning element 220J having a tension break point or necked portion 225J comprised of a through hole, causing the break point to be weaker then the surrounding areas of the tensioning element 200J.

Figure 8C:
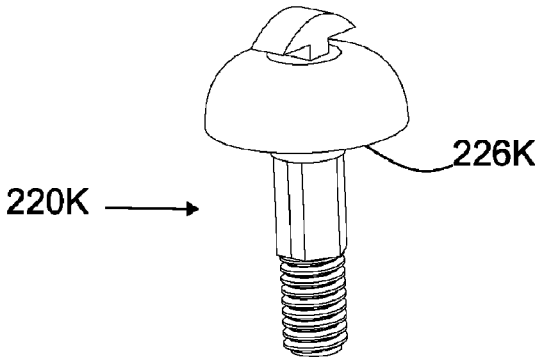
FIG. 8*c* is a perspective view of another embodiment of a tensioning element.

FIG. 8*c* is a perspective view of another embodiment of a tensioning element 220K that includes a catch 226K. The catch 226K may be shaped with a flat surface configured to engage with a complimentary surface of a first object.

Figure 8D:
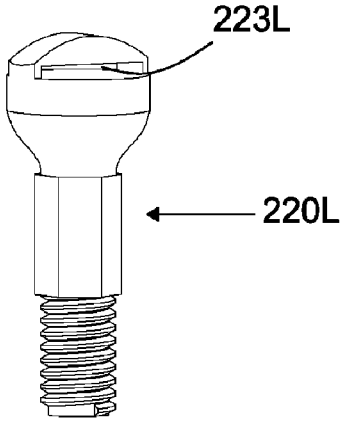
FIG. 8*d* is a perspective view of another embodiment of a tensioning element.

FIG. 8*d* is a perspective view of another embodiment of a tensioning element 220L that includes a torque break point 223L. The torque break point 223L may be comprised of a through hole, such that the torque break point 223L may be weaker then the surrounding areas of the tensioning element.

Figure 8E:
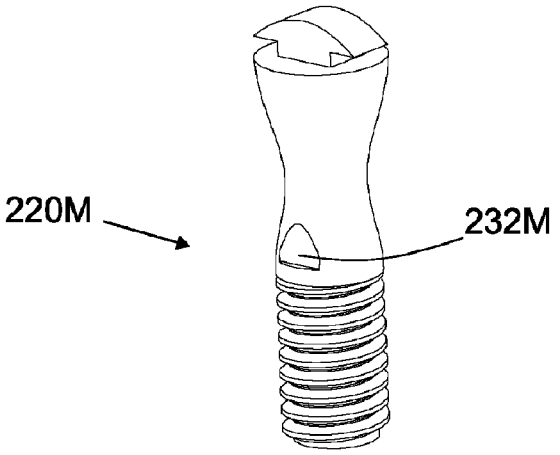
FIG. 8*e* is a perspective view of another embodiment of a tensioning element.

FIG. 8*e* is a perspective view of another embodiment of a tensioning element 220M that includes a wrench flat 2232M. The wrench flat 232M comprises an indent, such that a wrench may be able to engage the indent.

Figure 8F:
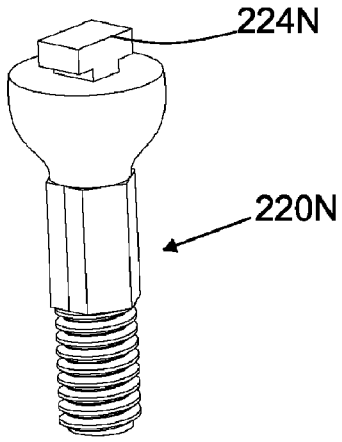
FIG. 8*f* is a perspective view of another embodiment of a tensioning element.

FIG. 8*f* is a perspective view of another embodiment of a tensioning element 220N that includes a breakaway torque member 224N. The breakaway torque member may comprise a square shape.

Figure 9A:
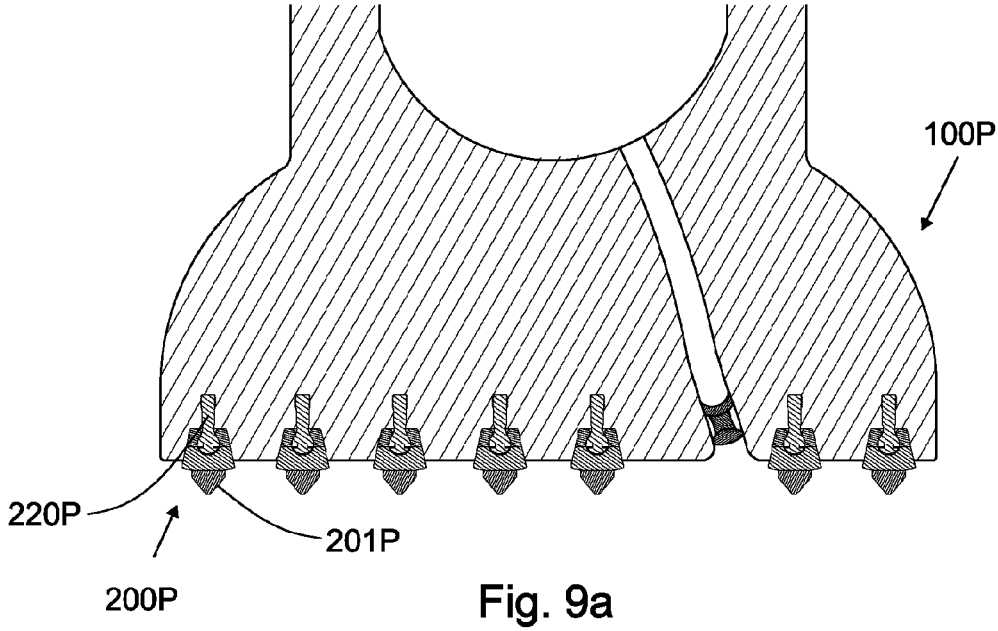
FIG. 9*a* is a schematic diagram of an embodiment of a percussion bit.

FIG. 9*a* discloses a degradation assembly 200P disposed within a percussion bit or driving mechanism 100P, with the tensioning element 220P securing the cutting structure 201P to the working face of the percussion bit 100P.

Figure 9B:
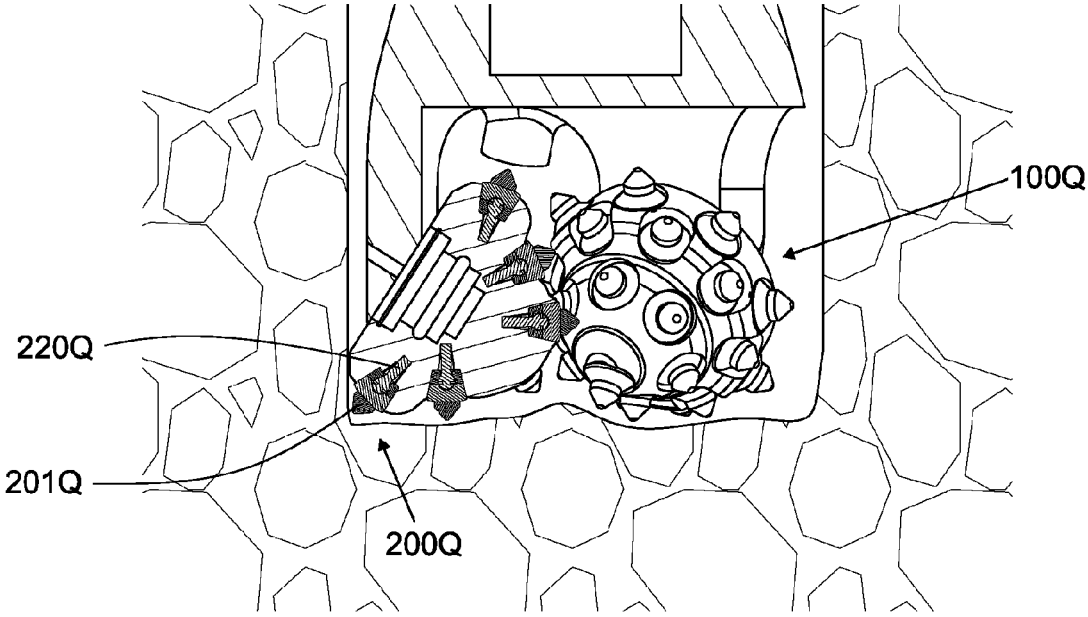
FIG. 9*b* is a schematic diagram of an embodiment of a roller cone bit.

FIG. 9*b* discloses a degradation assembly 200Q disposed within a roller cone bit or driving mechanism 100Q, with the tensioning element 220Q securing the cutting structure 201Q to the working face of the roller cone bit 100Q.

Figure 10A:
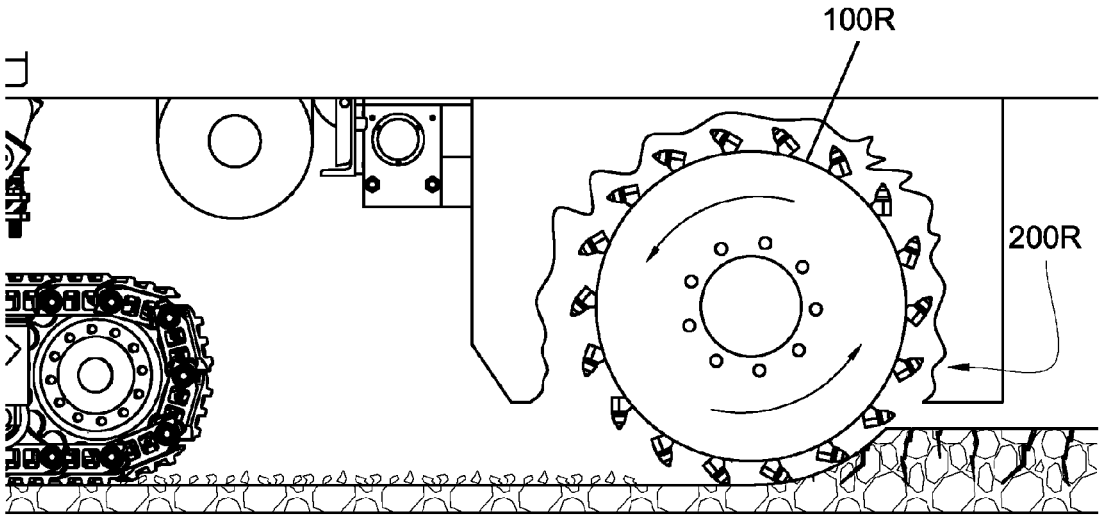
FIG. 10*a* is schematic diagram of an embodiment of an excavation drum.

FIG. 10*a* is a schematic diagram of a degradation assembly 200R disposed within an excavation drum or driving mechanism 100R of an excavation machine.

Figure 10B:
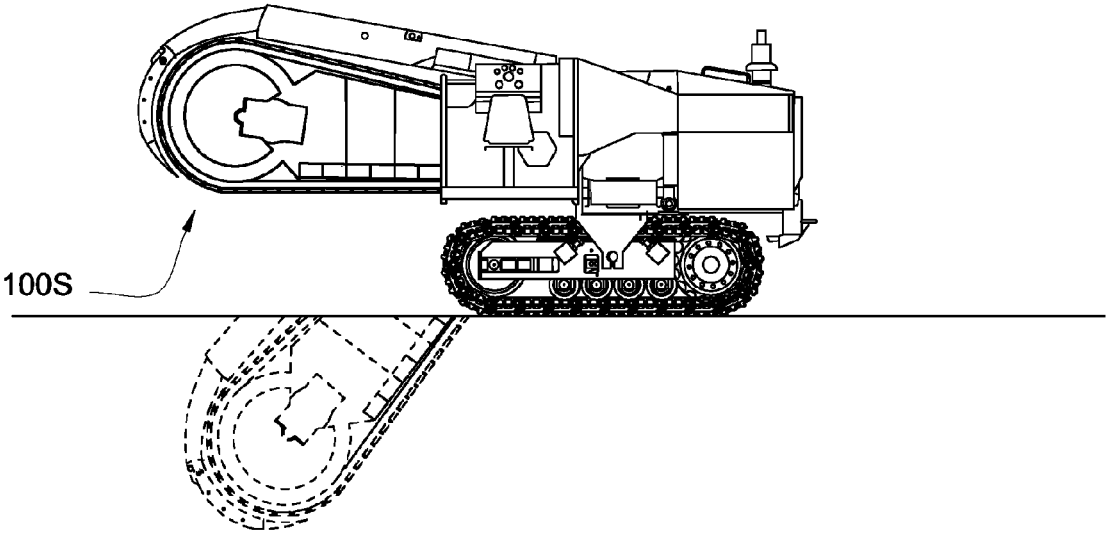
FIG. 10*b* is schematic diagram of an embodiment of a trencher.

FIG. 10*b* is a schematic diagram of a trencher with a blade or driving mechanism 100S. The blade may include a degradation assembly in which a cutting structure is attached to the blade 100S through a tensioning element.

Figure 11:
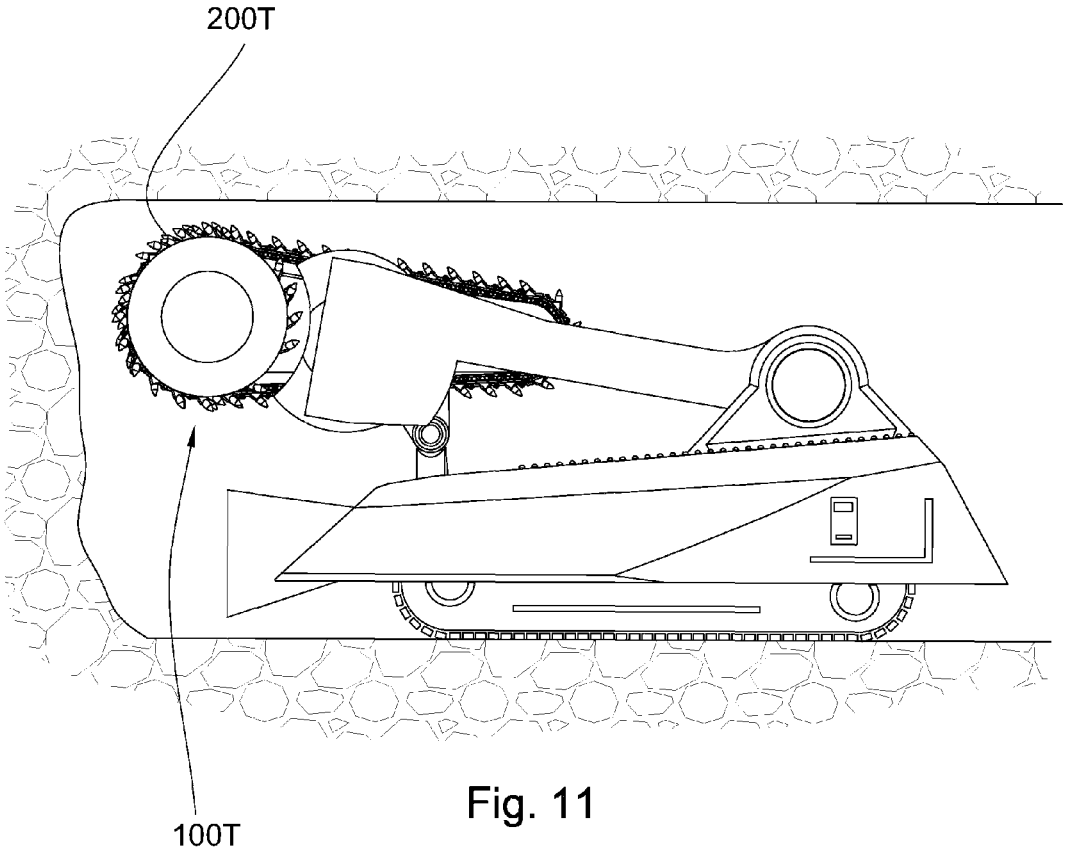
FIG. 11 is schematic diagram of an embodiment of a mining machine.

FIG. 11 is a schematic diagram of a mining machine. The working face of the rotating drum or driving mechanism 100T of the mining machine may comprise a plurality of degradation assemblies 220T.

Whereas the present invention has been described in particular relation to the drawings attached hereto, it should be understood that other and further modifications apart from those shown or suggested herein, may be made within the scope and spirit of the present invention.

What is claimed is:

1. A tensioning element being part of a degradation assembly and adapted to connect a cutting structure of the degradation assembly to a driving mechanism, the tensioning element comprising:

a breakaway tensile bearing interlocking geometry on a first end for engagement with the cutting structure and a thread formed on a second end for engagement with the driving mechanism; and a breakaway torque member affixed to the first end.

2. The tensioning element of claim 1, wherein the driving mechanism is selected from the group consisting of a downhole drill bit, an excavation drum, a mining machine and a blade of a trencher.

3. The tensioning element of claim 1, further comprising a removal interface disposed between the breakaway tensile bearing interlocking geometry and the thread.

4. The tensioning element of claim 3, wherein the removal interface comprises a wrench flat.

5. The tensioning element of claim 1, wherein the breakaway torque member is adapted to breakaway at a lower strain then the breakaway tensile bearing interlocking geometry.

6. The tensioning element of claim 1, wherein a torque required to break the breakaway torque member is greater then a torque required to seat the thread within a threaded hole formed into the driving mechanism.

7. The tensioning element of claim 1, wherein the breakaway tensile bearing interlocking geometry includes a catch.

8. The tensioning element of claim 7, wherein the cutting structure includes:

a carbide bolster, the carbide bolster having:

a working end and a base end spaced from the working end;

a first cavity formed therein, the first cavity having a first width;

an aperture extending through the base end to and in communication with the first cavity, the aperture having a second width less than the first width; and a second cavity formed therein in communication with the first cavity; and a tip attached to the working end, the tip including a super hard material.

9. The tensioning element of claim 8, wherein the carbide bolster comprises:

a lower section having the first cavity and the aperture formed therein; and an upper section having the second cavity formed therein, the first cavity and the second cavity surrounding and engaging the catch and the breakaway torque member, respectively, upon assembly of the upper section with the lower section.

10. The tensioning element of claim 8, wherein the catch of the tensioning element and the first cavity of the carbide bolster form a spherical ball joint socket.

11. The tensioning element of claim 1, wherein the cutting structure is adapted to rotate with respect to the tensioning element upon the breaking of the breakaway torque member.

12. The tensioning element of claim 1, wherein the cutting structure includes of a connection point adapted for connection to a puller.

13. A degradation assembly for degrading a formation, said degradation assembly being attachable to a driving mechanism, said degradation assembly comprising:

a cutting structure, said cutting structure including:

a bolster, said bolster having:

a working end and a base end spaced from said working end;

a first cavity formed therein, said first cavity having a first width;

an aperture extending through said base end to and in communication with said first cavity, said aperture having a second width less than said first width; and a second cavity formed therein in communication with said first cavity; and a tip attached to said working end, said tip being formed with a hardened material to engage said formation; and a tensioning element, said tensioning element including:

a body, said body having:

a first end with a first cross-sectional area and a second end with a second cross- sectional area, said second end being spaced apart from said first end;

an engaging structure extending away from said first end, said engaging structure being configured to fit within said first cavity and to inhibit removal of said first end through said aperture;

a thread formed proximate said second end, said thread being adapted to attach to said driving mechanism; and a necked portion between said engaging structure and said thread, said necked portion having a cross-sectional area less than said first cross-sectional area and second cross-sectional area, said necked portion configured to break when acted upon by a predetermined tensile force; and a torque member attached to and extending from said first end, said torque member being receivable within said second cavity, said torque member being adapted to transfer torque between said cutting structure and said body, said torque member having a torque break point configured to break when acted upon by a predetermined torque.

14. The degradation assembly of claim 13, wherein said engaging structure comprises a catch.

15. The degradation assembly of claim 13, wherein said engaging structure of said tensioning element and said first cavity of said bolster form a spherical ball and socket joint.

16. The degradation assembly of claim 13, wherein said bolster further comprises:

a lower section having said first cavity and said aperture formed therein; and an upper section having said second cavity formed therein, said first cavity and said second cavity surrounding and engaging said engaging structure and said torque member, respectively, upon assembly of said upper section with said lower section.

17. The degradation assembly of claim 13, wherein said predetermined torque is greater then a torque required to seat said thread within a threaded hole formed into said driving mechanism.

18. A degradation assembly for degrading a formation, said degradation assembly being attachable to a driving mechanism, said degradation assembly comprising:

a cutting structure, said cutting structure including:

a bolster, said bolster having:

a working end and a base end spaced from said working end;

a first cavity formed therein, said first cavity being formed to have a first transverse dimension and said first cavity including a first contact surface;

an aperture extending through said base end to and in communication with said first cavity, said aperture having a second transverse dimension less than said first transverse dimension; and a second cavity formed therein in communication with said first cavity; said second cavity being sized to and shaped to form at least one torque engagement surface; and a tip attached to said working end, said tip being formed with a hardened material to engage said formation; and a tensioning element, said tensioning element including:

a body, said body having:

a first portion having a first end and a second portion having a second end spaced from said first end;

an engaging structure extending away from said first end, said engaging structure being sized and shaped to fit in said first cavity and to have a second contact surface to engage said first contact surface and to inhibit movement of said engaging structure from said cavity into said aperture;

a first thread formed proximate said second end, said first thread being adapted to engage with a second thread associated with said driving mechanism; and a breakable union formed by joining said first portion with said second portion by joining means operable to break when acted upon by a predetermined tensile force; and a torque member attached to and extending from said engaging structure, said torque member being receivable within said second cavity, said torque member including:

a torque surface for engaging said torque engagement surface to transfer torque between said cutting structure and said body; and a torque break point operable to break when acted upon by a predetermined torque.

19. A degradation assembly for degrading a formation, said degradation assembly being attachable to a driving mechanism, said degradation assembly comprising:

a cutting structure, said cutting structure including:

a bolster, said bolster having a working end and a base end spaced from said working end, said bolster having an aperture formed into said base end; and a tip attached to said working end, said tip being formed with a hardened material for cutting said formation; and a tensioning element, said tensioning element including:

a body, said body including:

a first end and a second end spaced from said first end;

engagement means formed at said fist end, said engagement means for securing said body within said aperture;

attachment means formed at said second end, said attachment means for attaching said body to said driving mechanism; and breakaway tensile means formed between said engagement means and said attachment means, said breakaway tensile means for breaking when acted upon by a predetermined tensile force; and breakaway torque means extending from said first end, said breakaway torque means for transferring torque between said cutting structure and said body and for breaking when acted upon by a predetermined torque.

* * * * *